US006725584B2

(12) United States Patent
Inoue et al.

(10) Patent No.: US 6,725,584 B2
(45) Date of Patent: Apr. 27, 2004

(54) QUICK CONNECT/DISCONNECT SYSTEM FOR AN ARM OF EXCAVATOR OR OTHER MACHINE

(75) Inventors: Yonezo Inoue, Chattanooga, TN (US); Allen E. Kimble, Rock Spring, GA (US)

(73) Assignee: JRB Company, Inc., Akron, OH (US)

( * ) Notice: Subject to any disclaimer, the term of this patent is extended or adjusted under 35 U.S.C. 154(b) by 0 days.

(21) Appl. No.: 10/154,155

(22) Filed: May 22, 2002

(65) Prior Publication Data

US 2002/0174575 A1 Nov. 28, 2002

Related U.S. Application Data

(60) Provisional application No. 60/292,567, filed on May 22, 2001.

(51) Int. Cl.[7] ..... E02F 3/96

(52) U.S. Cl. ..... 37/468; 37/403; 414/723; 414/694

(58) Field of Search ..... 37/468, 403; 414/723, 414/698, 694

(56) References Cited

U.S. PATENT DOCUMENTS

| | | | | | |
|---|---|---|---|---|---|
| 3,149,737 | A | * | 9/1964 | Guinot | 414/694 |
| 3,388,819 | A | * | 6/1968 | Przybylski | 414/694 |
| 3,977,548 | A | * | 8/1976 | McCannon et al. | 414/694 |
| 4,571,146 | A | * | 2/1986 | Eriksson | 414/687 |
| 4,775,287 | A | * | 10/1988 | Hering, Sr. | 414/694 |
| 4,938,651 | A | * | 7/1990 | Gilmor et al. | 414/694 |
| 5,108,252 | A | * | 4/1992 | Gilmore, Jr. et al. | 414/694 |
| 5,199,844 | A | * | 4/1993 | Gilmore, Jr. et al. | 414/694 |
| 5,324,162 | A | * | 6/1994 | Kishi | 414/723 |
| 5,360,313 | A | * | 11/1994 | Gilmore, Jr. et al. | 414/694 |
| 5,423,625 | A | | 6/1995 | Gebauer et al. | |
| 5,484,250 | A | * | 1/1996 | Gilmore, Jr. et al. | 414/723 |

FOREIGN PATENT DOCUMENTS

| | | | |
|---|---|---|---|
| JP | 5-132969 | * | 5/1993 |

* cited by examiner

*Primary Examiner*—Robert E. Pezzuto
*Assistant Examiner*—Thomas A. Beach
(74) *Attorney, Agent, or Firm*—Fay, Sharpe, Fagan, Minnich & McKee, LLP

(57) ABSTRACT

A quick connect/disconnect system for an arm of an excavator or other machine includes a boom comprising a distal end defining a first yoke structure including first and second yoke members, and each of the yoke members includes an open pin-receiving recess. An arm includes first and second pin-ends projecting outwardly therefrom. The first pin-end is seated in the recess of the first yoke member and said second pin-end is seated in the recess of the second yoke member. First and second arm keepers are located respectively adjacent the first and second recesses and selectively capture the first and second pin-ends. The system optionally includes a second yoke with first and second yoke members that respectively include first and second open pin-receiving recesses. An arm cylinder includes first and second cylinder pin-ends projecting outwardly therefrom. The first cylinder pin-end is seated in the first recess of the second yoke and the second pin-end is seated in the second recess of the second yoke. First and second cylinder keepers selectively capture the first and second cylinder pin-ends. The system also optionally includes a cylinder support assembly for supporting the arm cylinder relative to the boom when the arm is disconnected from the boom.

13 Claims, 6 Drawing Sheets

FIG. 5
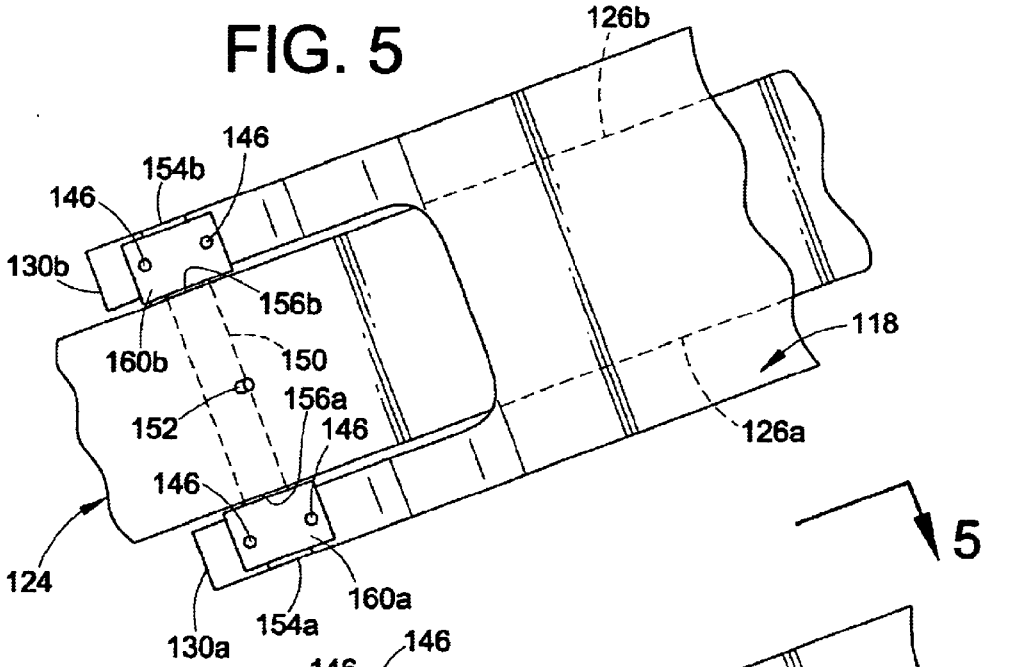
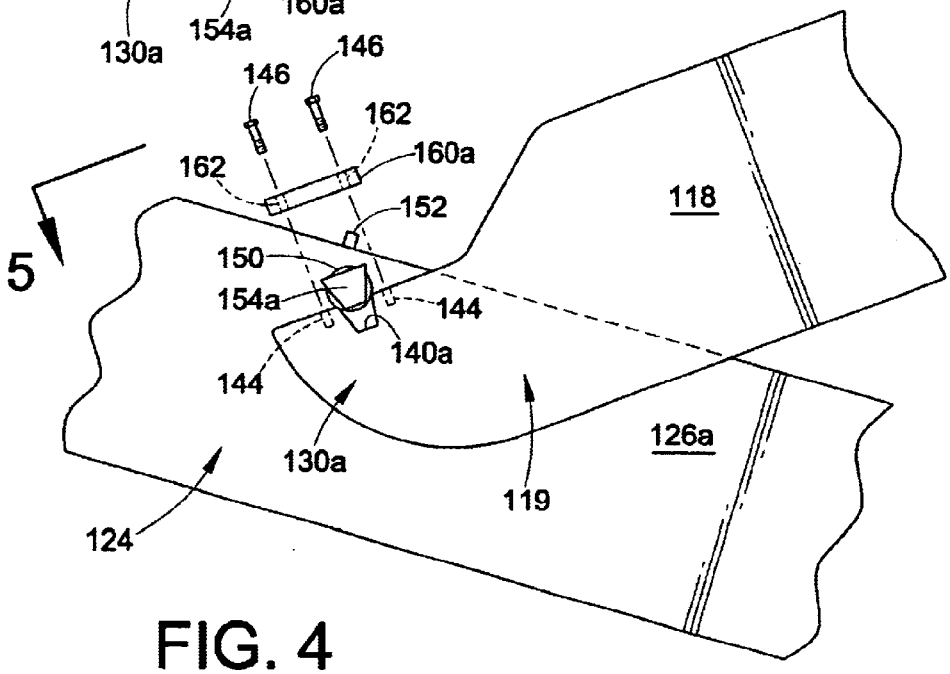
FIG. 4

FIG. 7
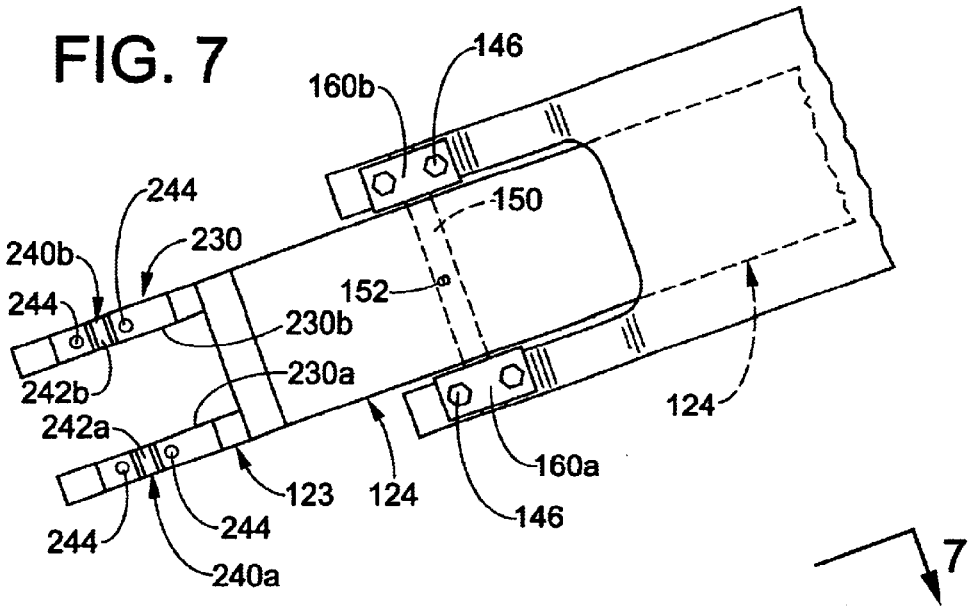
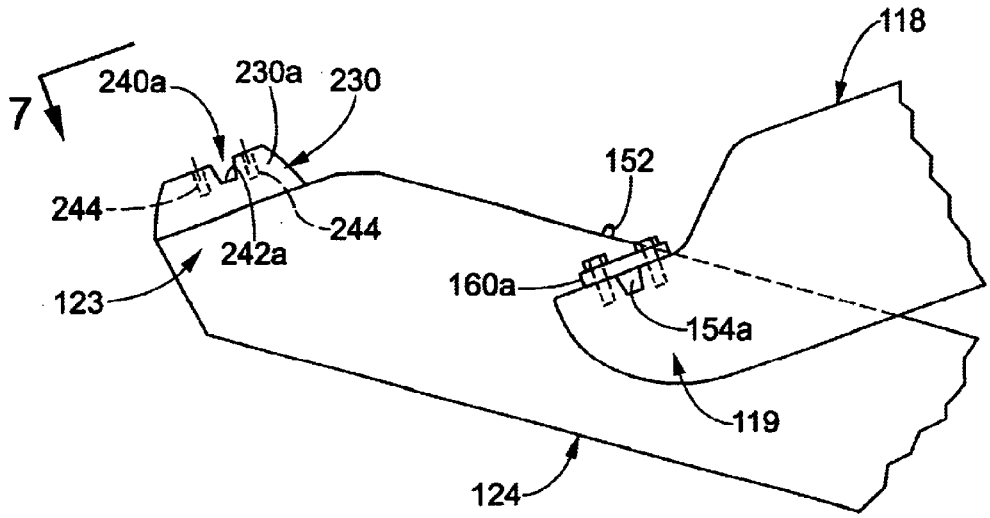
FIG. 6

FIG. 9
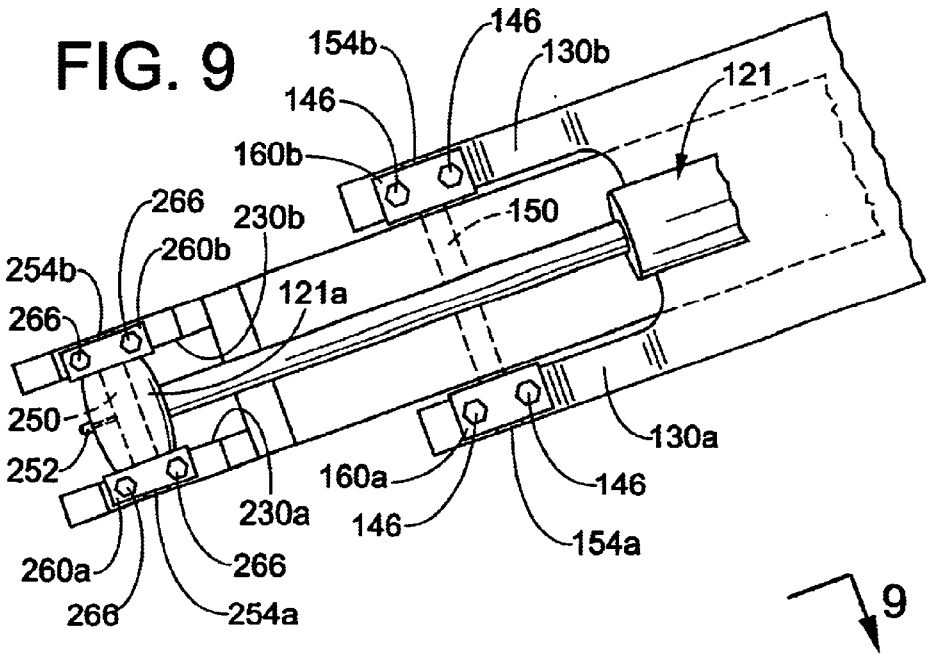
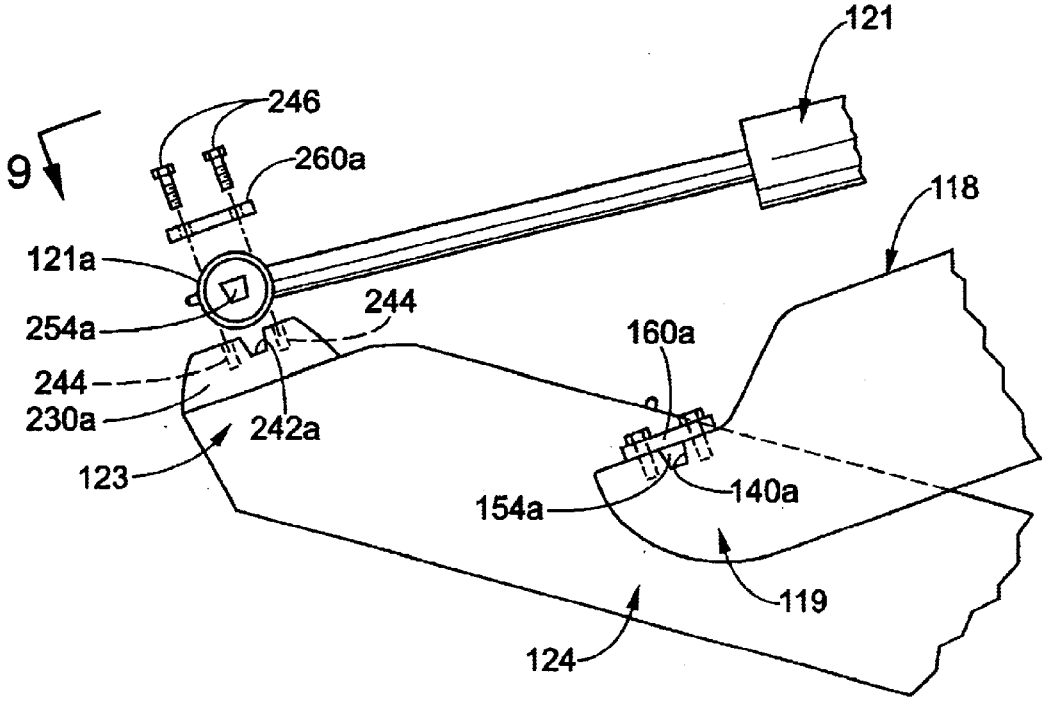
FIG. 8

QUICK CONNECT/DISCONNECT SYSTEM FOR AN ARM OF EXCAVATOR OR OTHER MACHINE

CROSS-REFERENCE TO RELATED APPLICATION

This applications claims priority from and hereby expressly incorporates by reference U.S. provisional application No. 60/292,567 filed May 22, 2001.

BACKGROUND OF THE INVENTION

The present invention relates generally to an improved system for operatively connecting an arm, shear, or other "second member" to a boom of an excavator or like apparatus. In particular, the present invention relates to an improved system that facilitates connection of the second member to the distal end of the boom, and that also facilitates connection of the associated fluid cylinder to the second member. For ease of understanding the invention, it will be described with particular reference to excavators and the connection of an arm member to the distal end of the excavator boom and for connection of the arm cylinder to the arm. Of course, those of ordinary skill in the art will appreciate that the invention has wider application and provides a system for connection/disconnection of any member or implement to the distal end of a boom, whether the boom is carried by an excavator or another prime mover such as a tractor, a backhoe, or the like.

Excavators are well known and widely used in various industries. Typically, such excavators include a boom extending from a base to an outwardly extending distal end, at which end an arm (or "dipper stick") or another second member, such as a shear or a grapple, is attached. The arm pivots relative to the boom under the force of an arm fluid cylinder, and the distal end of the arm is adapted for operative securement of an implement thereto such as a shovel or bucket for removing and depositing earth or the like. Other industries, such as the materials handling industry, employ shears, grapples, magnets, and other such devices at the distal end of the arm. Regardless of the type of implement located at the end of the arm, it will be understood by those skilled in the art that an excavator employs fluid cylinders and the like for raising and lowering the boom, the arm, for moving the implement relative to the arm, and for operating any mechanisms of the implement, itself.

In a most basic arrangement, the arm or other second member is manually pinned to the distal end of the excavator boom, and the cylinder that pivots the arm (referred to herein as the "arm cylinder") is likewise manually pinned to the arm. These pinning operations require manual removal and replacement of pins through aligned apertures in the different members to achieve the desired engagement/disengagement. The removal and replacement of such pins involves manually and hydraulically manipulating the boom, the arm, and the arm cylinder, and sliding movement of the pin, itself, typically under force of one or more hammers. Obviously, the arm connection/disconnection operation is inconvenient, time-consuming, and difficult.

Second member quick couplings have been developed and have enjoyed commercial success. One suitable second member quick-coupling is commercially available from JRB Company, Inc., Akron, Ohio and is described in U.S. Pat. No. 5,423,625, the disclosure of which patent is hereby expressly incorporated by reference herein. Such quick-couplings are pinned to the distal end of the boom and, once in place, are adapted for selective connection to any of a wide variety of arms or other second members in a convenient and secure manner. More particularly, these prior quick couplings include mechanisms for selectively mating with and retaining the standard pins of an associated second member.

While the second member quick-coupling described in the aforementioned U.S. Pat. No. 5,423,625 has been found to be very advantageous, a need has been identified for an alternative connect/disconnection system for an arm or other second member that is smaller, lighter, and less expensive, while still providing fast, convenient, safe, and effective connection of an arm and or other second member to the distal end of a boom.

SUMMARY OF THE INVENTION

In accordance with the present invention, a novel and non-obvious quick connect/disconnect system for an excavator arm or other second member is provided.

In accordance with a first aspect of the development, a quick connect/disconnect system for an arm of an excavator or other machine includes a boom comprising a distal end defining a first yoke structure comprising first and second yoke members, and each of the yoke members comprises an open pin-receiving recess. An arm includes a distal end adapted for operative connection to an associated work implement. The arm comprises first and second pin-ends projecting outwardly from opposite lateral sides of the arm. The first pin-end is seated in the pin-receiving recess of the first yoke member and said second pin-end is seated in the pin-receiving recess of the second yoke member. First and second arm keepers are located respectively adjacent the first and second pin-receiving recesses and selectively capture the first and second pin-ends in the first and second recesses.

In accordance with another aspect of the present development, a quick connect/disconnect system for an arm of an excavator or other machine includes a boom comprising a distal end including first and second open pin-receiving recesses. An arm comprises first and second pin-ends projecting outwardly from opposite lateral sides thereof. The first pin-end is seated in the first pin-receiving recess and the second pin-end is seated in the second pin-receiving recess. First and second arm-pin keepers are located respectively adjacent the first and second pin-receiving recesses and selectively capturing the first and second pin-ends in the first and second recesses.

In accordance with still another aspect of the present development, a machine comprises a boom and a fluid cylinder connected to the boom. A cylinder support assembly is connected to the boom or the fluid cylinder and is adapted for temporarily supporting the fluid cylinder relative to the boom. The cylinder support assembly is selectively movable from a storage position to an extended operative position. The cylinder support assembly supports the fluid cylinder and maintains the fluid cylinder in a select position relative to the boom when in the extended operative position.

One advantage of the present invention resides in the provision of a system for operatively connecting a second member to an associated boom in a simple and effective manner without requiring alignment of apertures and insertion of multiple pins through the aligned apertures.

Another advantage of the present invention is found in the provision of a quick connect/disconnect system for an excavator arm or other second member that eliminates the need to manually remove and insert pins with hammers and the like.

Still another advantage of the present invention is that it provides a system for connecting an arm or other second member to the distal end of a boom, and for connecting an arm cylinder to the arm or other second member, wherein rotation of the connector pins is prevented to minimize the points where lubrication is required.

Yet another advantage of the present invention resides in its provision of a quick connect/disconnect system for an arm or other second member, wherein an assembly is provided to support the arm cylinder in a select position spaced from the boom to facilitate connection/disconnection of the arm cylinder in the arm connection/disconnection operation.

Still other benefits and advantages of the present invention will become apparent to those of ordinary skill in the art to which the invention pertains upon reading and understanding the following specification.

BRIEF DESCRIPTION OF THE DRAWINGS

The invention takes form from various components and arrangements of components, preferred embodiments of which are illustrated in the accompanying drawings that form a part hereof and wherein:

FIG. 4 is an exploded partial side elevational view of the excavator boom shown in FIG. 2 as it is operatively connected to an excavator arm formed in accordance with the present invention;

FIG. 5 is a non-exploded view taken along line 5—5 of FIG. 4;

FIG. 6 is a partial side elevational view of an excavator boom and an excavator arm operatively connected thereto, both formed in accordance with the present invention;

FIG. 7 is a view taken along line 7—7 of FIG. 6;

FIG. 8 is a partial side elevational view similar to FIG. 6, but including an exploded showing of the operative connection of an arm cylinder to the arm;

FIG. 9 is a fully assembled view, taken along line 9—9 of FIG. 8;

DETAILED DESCRIPTION OF PREFERRED EMBODIMENTS

Figure 1:
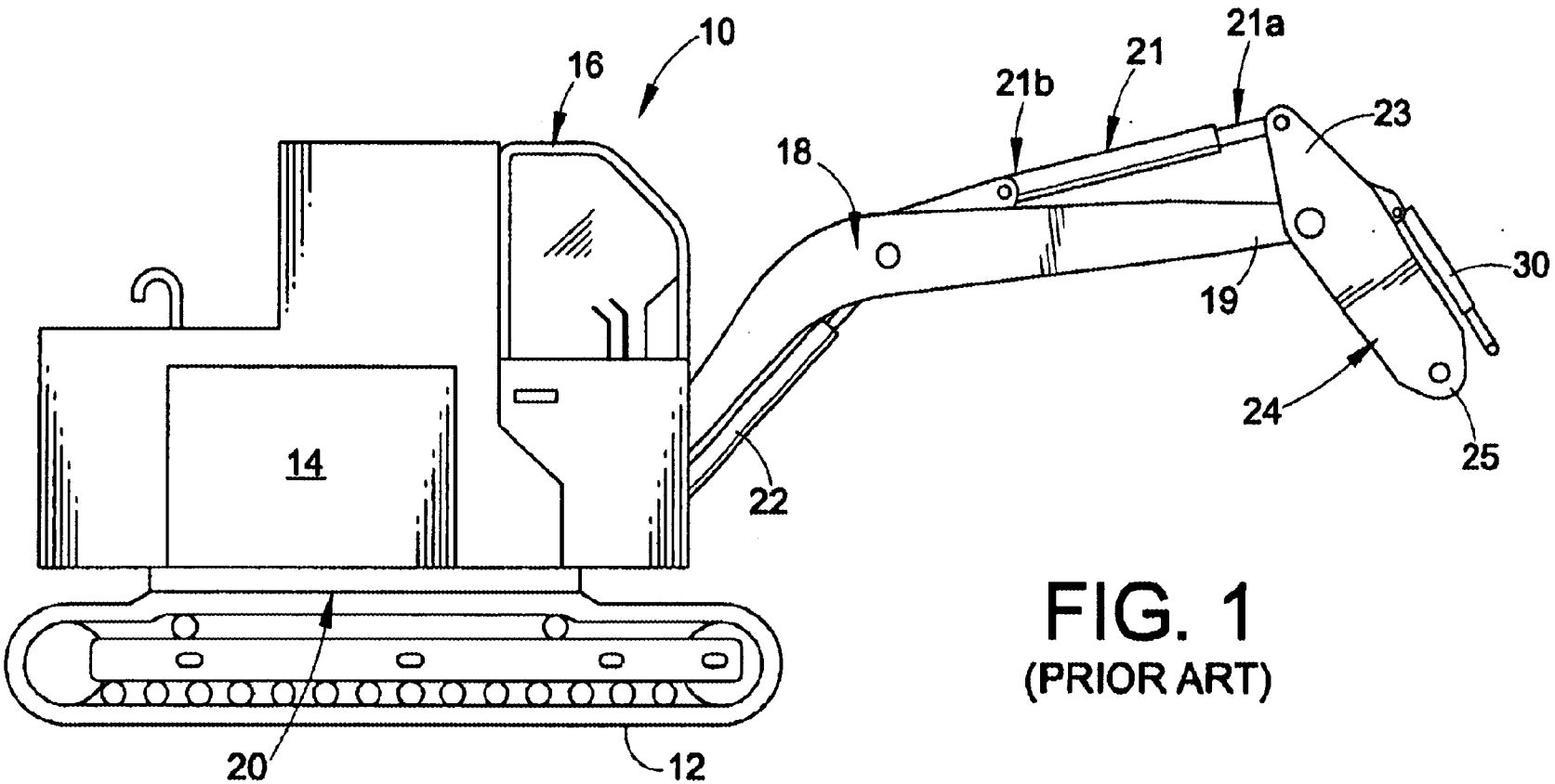
FIG. 1 (PRIOR ART)
FIG. 1 illustrates a prior art excavator or like apparatus wherein an arm is pinned to the boom and the arm cylinder pinned to the arm in a conventional manner.

Referring now to the drawings, wherein the showings are for purposes of illustrating preferred embodiments of the invention only and not for purposes of limiting same, FIG. 1 illustrates one example of an excavator of the type in connection with which a quick connect/disconnect system for an arm or other second member formed in accordance with the present invention may be advantageously employed. The excavator 10 is movable upon tractor or roller chain treads 12 in standard fashion. An engine or power unit 14, such as a diesel engine or the like, is operative to drive the treads 12 and the various hydraulic pumps, generators, and systems employed in the operation of the excavator as is well known. A cab 16 is maintained upon a base 20 for accommodating an operator controlling the excavator 10.

A boom 18 extends upwardly from the base 20 and is movable in elevation by means of hydraulic pistons 22. At the distal end 19 of the boom 18, the proximal end 23 of an arm or "dipper stick" 24 is pivotally attached. A shovel, bucket, or other implement (not shown) can be maintained at the distal end 25 of the arm 24 using a conventional pin-on or a quick-coupling connection. An implement fluid cylinder 30 is operatively connected to the arm 24, and to the associated implement (not shown) to control movement of the implement as is also well known and understood by those skilled in the art. An arm fluid cylinder 21 is interposed between the boom 18 and the proximal end 23 of the arm 24 for achieving pivotal movement between these two members, again in a fashion well known and understood in the art. More particularly, the arm cylinder includes a distal end 21*a* operatively coupled to the proximal end 23 of the arm 24 and includes a proximal end 21*b* operatively coupled to the boom 18.

Figure 3:
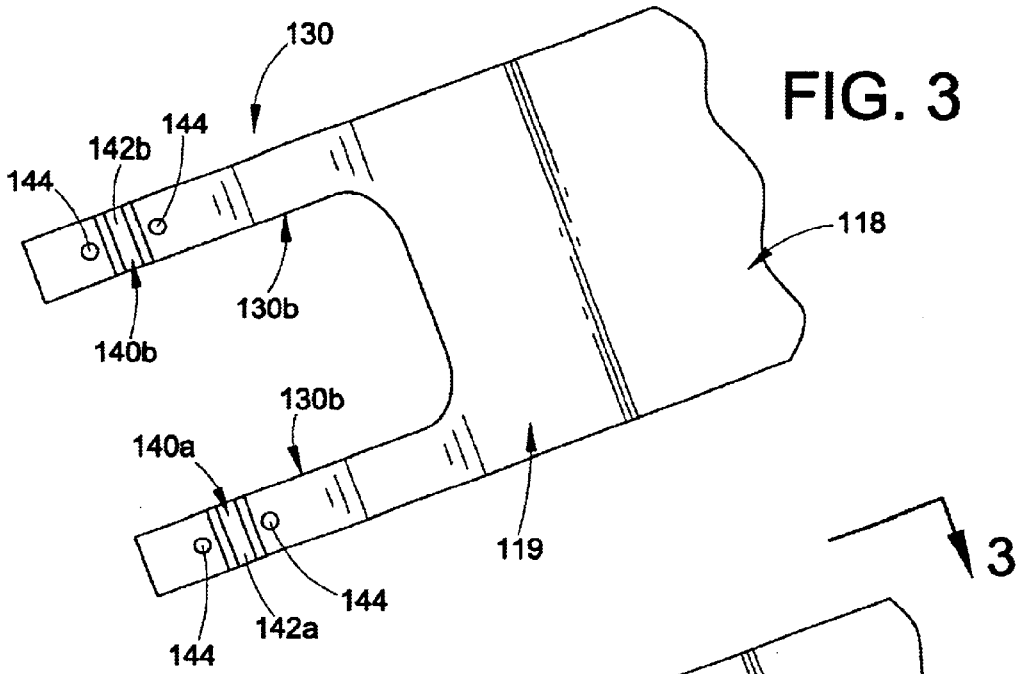
FIG. 3 is a view taken along line 3—3 of FIG. 2.
Figure 2:
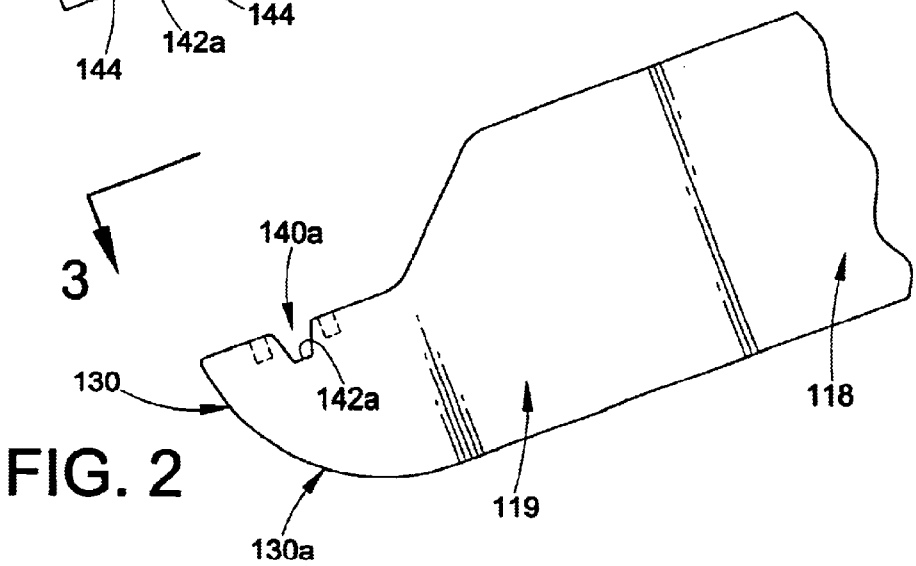
FIG. 2 is a partial side elevational view of a distal end of an excavator boom formed in accordance with the present invention.

Referring now to FIGS. 2 and 3, a boom 118 formed in accordance with the quick connect/disconnect system of the present invention is partially illustrated. Except as otherwise shown and described herein, the boom 118 is identical to a conventional boom 18. The boom 118 includes a distal end 119 comprising a yoke structure 130 that is adapted to receive and associated arm or other second member (not shown in FIGS. 2 and 3) loosely between first and second yoke members 130*a*,130*b*. The yoke members 130*a*,130*b* respectively include or define open pin-receiving recesses 140*a*,140*b* that preferably, but not necessarily, open upwardly, i.e., generally away from the earth or other surface upon which the excavator 10 is supported when the distal end 19 of the boom 118 extends horizontally. In the illustrated preferred embodiment, the recesses 140*a*,140*b* taper or narrow moving toward their respective innermost ends 142*a*,142*b*. Adjacent each recess 140*a*,140*b* two or more threaded bores 144 are defined in the yoke members 130*a*, 130*b*. Although it is preferred that the recesses 140*a*,140*b* are defined directly in the boom 118 or a member permanently connected to the boom 118, those of ordinary skill in the art will recognize that the recesses could be defined in one or more members that are removably connected to a conventional boom 18 using pins or the like.

Turning now to FIGS. 4 and 5, the boom 118 just described is illustrated together with an arm or other second member 124 that is to be operatively connected to the boom 118. Except as otherwise shown and described, the arm 124 is identical to the arm 24 described above. The arm 124 rotatably carries a horizontally extending cross-pin 150 projecting outwardly from opposite lateral sides 126*a*,126*b* thereof. A lubrication fitting 52 is provided for periodic application of a lubricant to the interface between the pin 150 and the arm 124. More particularly, the pin includes first and second opposite pin-ends 154*a*,154*b* that project outwardly from the opposite lateral sides of the arm 126*a*,126*b*, respectively. These first and second pin-ends 154*a*,154*b* are adapted for respective close, sliding and, preferably, non-rotatable receipt in the tapered recesses 140*a*,140*b* and are, thus, preferably shaped to conform exactly or closely to the shape of the recesses 140*a*,140*b*. Those of ordinary skill in the art will recognize that the first and second pin-ends 154*a*,154*b* need not be part of a single cross-pin 150 but can, instead, be separate from each other, i.e., the ends 154*a*,154*b* can be part of first and second separate pins connected to the arm.

First and second keepers such as caps 160*a*,160*b* are provided and are adapted for selective connection to the yoke members 130*a*,130*b*, respectively, to secure the pin ends 154*a*,154*b* in their respective recesses 140*a*,140*b*. In the illustrated embodiment, the caps 160*a*,160*b* include apertures 162 that slidably receive fasteners 146, and the fasteners 146 are, in turn, threadably secured in the threaded bores 144 of the boom 118. Alternatively, the boom 118 can comprise slidable or otherwise movable latch members that selectively close the recesses 140*a*,140*b* to capture the pin ends 154*a*,154*b* therein. Those of ordinary skill in the art will recognize that, by conforming the recesses 140*a*,140*b* and the pin ends 154*a*,154*b* so that they non-rotatably engage, no lubrication is required in the recesses 140*a*,140*b*. Referring particularly to FIG. 5, it is also preferred that the caps 160*a*,160*b* closely abut shoulders 156*a*,156*b* of the pin 150 so that lateral movement of the pin 150 in the recesses 140*a*,140*b* is minimized.

Referring now to FIGS. 6 and 7, an arm 124 and boom 118, both formed in accordance with the present invention, are operatively interconnected as described above. The proximal end 123 of the arm 124 is also illustrated and comprises a yoke conformation 230 adapted for operative and pivotal interconnection to the arm cylinder (not shown in FIGS. 6 and 7) by which the arm 124 is pivoted relative to the boom 118. More particularly, the yoke conformation 230 is defined by first and second laterally spaced-apart yoke members 230*a*,230*b*. The yoke members 230*a*,230*b* respectively include or define recesses 240*a*,240*b* that preferably open generally upwardly, i.e., away from the earth or other surface upon which the excavator 10 is supported when the arm 124 is fully curled relative to the boom 118. As with the boom recesses 140*a*,140*b* described above, the recesses 240*a*,240*b* taper moving inwardly toward their innermost ends 242*a*,242*b*. Adjacent each recess 240*a*,240*b*, two or more threaded bores 244 are defined. Although it is preferred that the recesses 240*a*,240*b* be defined directly in the proximal end 123 of the arm 124, those of ordinary skill in the art will recognize that the recesses could be defined in a member or members adapted for selective connection to the proximal end 23 of a conventional arm 24 using pins or the like.

FIGS. 8 and 9 are similar to FIGS. 6 and 7, but further illustrate operative connection of an arm cylinder 121 to the proximal end 123 of the arm 124. The cylinder 121 is identical to a conventional arm cylinder 21 except the distal end 121*a* of the cylinder 121 rotatably supports a horizontally extending cross-pin 250, and a fitting 252 is provided for periodic application of lubricant to the interface between the pin 250 and the end 121*a* of the arm cylinder 121. The cross-pin pin 250 includes first and second opposite pin-ends 254*a*,254*b* that project laterally outwardly from the distal end 121*a* of the cylinder 121. These pin-ends 254*a*,254*b* are adapted for close, sliding, non-rotatable receipt in the tapered recesses 240*a*,240*b* and are, thus, defined in a tapered manner to conform to the recesses 240*a*,240*b*. It should be noted that the distal end 121*a* of the cylinder 121 can alternatively connected to the proximal end 123 of the arm 124 by way of a conventional pin-on or other conventional connection, i.e., the yoke conformation 230 can be replaced by a simple aperture that allows for a pin-on connection of the distal end 121*a* of the cylinder 121. Also, as noted above with respect to the first and second pin-ends 154*a*,154*b*, the first and second pin-ends 254*a*,254*b* need not be part of a single cross-pin 150 but can, instead, be separate from each other, i.e., the pin-ends 254*a*,254*b* can be part of first and second separate pins connected to the distal end 121*a* of the cylinder 121.

First and second keepers such as caps 260*a*,260*b* are provided and are adapted for selective releasable connection to the yoke members 230*a*,230*b*, respectively, to capture and hold the pin ends 254*a*,254*b* in their respective recesses 240*a*,240*b*. The first and second caps 260*a*,260*b* are operatively secured to the yoke members 230*a*,230*b* by insertion of the fasteners 246 through apertures defined in the caps 260*a*,260*b* and threadable securement of the fasteners in the bores 244. Of course, the first and second caps 260*a*,260*b* can be replaced with slidable or otherwise movable members that can be selectively positioned to close the recesses 240*a*,240*b* and capture the pin ends 254*a*,254*b* respectively therein. Due to the non-rotatable engagement of the pin ends 254*a*,254*b* with the recesses 240*a*,240*b*, no lubrication need be provided between these members. As is readily apparent in FIG. 9, the caps 260*a*,260*b* abut the distal end 121*a* of the arm cylinder 121 to prevent or at least minimize lateral movement of the cylinder end 121*a* between the yoke members 230*a*,230*b*.

Connection of the arm 124 (or other second member) to the distal end 119 of the boom 118 is carried out by positioning the arm 124 between the yoke members 130*a*, 130*b* of the boom 118 and raising the distal end 119 of the boom 118 until the pin ends 154*a*,154*b* are received respectively in the recesses 140*a*,140*b*. The pin ends 154*a*,154*b* are then captured in their respective recesses 140*a*,140*b* by operative connection of the caps 160*a*,160*b* to the yoke members 130*a*,130*b* or otherwise. Thereafter, the distal end 121*a* of the cylinder 121 is manually and hydraulically positioned so that the pin ends 254*a*,254*b* are received in the recesses 240*a*,240*b*, respectively, at the proximal end 123 of the arm 124. The pin ends 254*a*,254*b* are then captured in their respective recesses 240*a*,240*b* by operative connection of the caps 260*a*,260*b* to the yoke members 230*a*,230*b*, respectively, or by other suitable means. Of course, disconnection of the arm 124 or other second member is equally convenient—the arm or other member 124 is fully curled relative to the boom 118, placed on the earth or other surface supporting the excavator or other prime mover 10, and the above procedure is reversed.

It is preferred that the ends 154*a*,154*b* of the pin 150 and the ends 254*a*,254*b* of the pin 250 be non-cylindrical and shaped in accordance with the recesses 140*a*,140*b* and 240*a*,240*b*, respectively, to prevent rotation of the pin ends 154*a*,154*b* and 254*a*,254*b* in their respective recesses. Of course, those of ordinary skill in the art will recognize that the pin ends can be cylindrical in shape, and the recesses partially cylindrical (e.g., semi-cylindrical) in shape so that the pin ends rotate in their respective recesses. Further, in this alternative embodiment, other means can be employed, such as a set-screw or the like, to restrain the pins 150,250 against rotation in the recesses. It is not intended that the invention be limited to the particular embodiment illustrated in the drawings.

Figure 11:
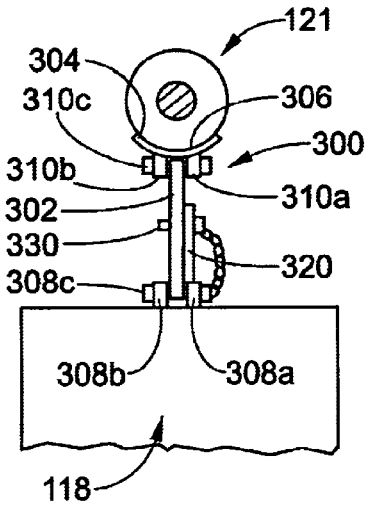
FIG. 11 is a view taken along line 11—11 of FIG. 10.
Figure 12:
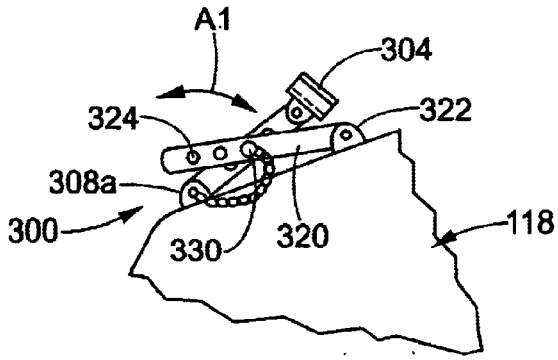
FIG. 12 is a side elevational view of the cylinder support assembly moved into its folded, storage position.
Figure 10:
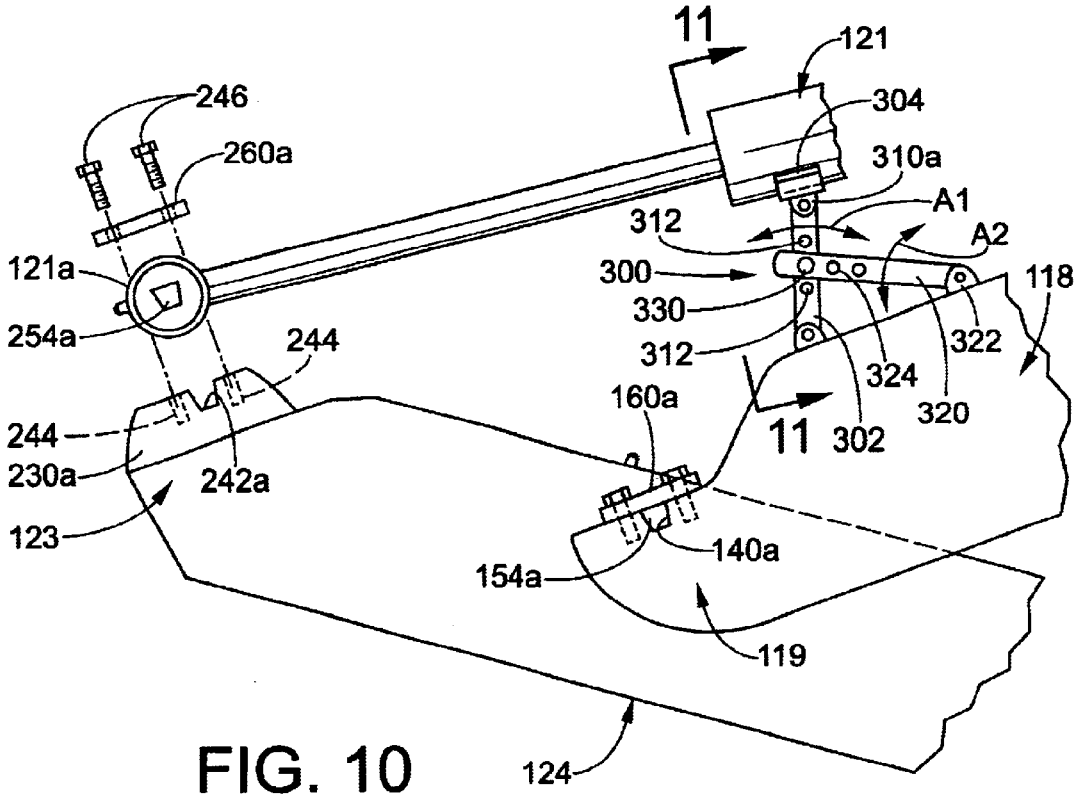
FIG. 10 is a partial side elevational view similar to FIG. 8, but further illustrating a cylinder support assembly formed in accordance with the present invention.

FIGS. 10–12 illustrate a cylinder support assembly 300 preferably provided as a part of the quick connect/disconnect system for an excavator arm formed in accordance with the present invention. The support assembly 300 is located between the boom 118 and the arm cylinder 121, connected to at least one of the boom 118 and cylinder 121, and is used as a temporary support (as opposed to wooden blocks or the like) to maintain the cylinder 121 at a select height above the boom 118 when the distal end 121*a* of the cylinder is disconnected from the arm 124. The cylinder support assembly 300 comprises a support link 302, preferably defined from metal, pivotably connected to the boom 118 for movement on an arc denoted A1. The distal end of the support link 302 pivotably supports a cylinder cradle 304 that defines a cylinder support surface 306 (FIG. 11). With continuing reference to FIG. 11, first and second ears 308*a*,308*b* preferably project upwardly from the boom 118 and include aligned apertures formed therethrough. A pin or other fastener 308*c* is received through the aligned apertures defined in the ears 308*a*,308*b* and also through an aligned aperture defined in the support link 302 when the support link 302 is placed between the ears 308*a*,308*b* so that the support link 302 is pivotably interconnected to the boom 118 with a pin-on arrangement. The cylinder support cradle 304 includes ears 310*a*,310*b* with aligned apertures defined therein, and a pin or other fastener 310*c* is inserted through the apertures defined in these ears 310*a*,310*b* and through an aligned aperture defined in the distal end of the support link 302 when the support link 302 is positioned between the ears 310*a*,310*b* so as to pivotably connect the cradle 304 to the link 302. The support link 302 also includes a plurality of adjustment apertures 312 defined therethrough along its length. Those of ordinary skill in the art will recognize that the support link 302 is adapted for being pivoted on the arc A1 from a folded, storage position (FIG. 12) wherein the cradle 304 lies adjacent the boom 118, to an extended, operative position (FIGS. 10 and 11), wherein the cradle is spaced-apart from the boom 118 and positioned to receive the cylinder 121 on the support surface 306.

A stop link 320, preferably defined from metal, is also pivotably connected to the boom 118 and adapted for movement along an arc denoted A2. The stop link 320 is connected to the boom 118 by way of a pin-on connection via one or more ears 322 that project upwardly from the boom 118 in a manner similar or identical to the pin-on connection of the support link 302 to the boom 118. The stop link 320 also defines a plurality of adjustment apertures 324 along its length.

As illustrated in FIGS. 10 and 11, once the support link 302 is operatively positioned so that the cradle 304 supports the cylinder 121, the stop link 320 and/or the support link 302 are moved relative to each other until a desired one of the adjustment apertures 312 defined in the support link 302 becomes aligned with a desired one of the adjustment apertures 324 defined in the stop link 320. A stop pin 330 is then inserted through the aligned adjustment apertures 312, 324 to prevent further movement of the link members 302,320 on their respective arcs A1,A2. Those of ordinary skill in the art will recognize that, in this operative position, the support link 302 will support the cylinder 121 in a fixed position spaced from the boom 118 to facilitate connection/disconnection of the distal end 121*a* of the cylinder 121 to/from the arm 124.

The support link 302 is also movable to a folded, storage position as illustrated in FIG. 12. In this storage position, the cradle 304 lies adjacent the boom 118 so that it does not interfere with operation of the boom 118, the arm cylinder 121, or arm 124. Here, again, the stop pin 330 is preferably inserted through aligned adjustment apertures 312,324 in the support link 302 and the stop link 320, respectively, to fix the support link 302 in its storage position while it is not being used to support the cylinder 121. While the support link 302 and stop link 320 have been disclosed as connected to the boom 118, those of ordinary skill in the art will recognize that either or both can alternatively be connected to the cylinder 121 without departing from the overall scope and intent of the present invention.

The invention has been described with reference to preferred embodiments. Of course, modifications and alterations will occur to others upon a reading and understanding of the preceding specification. It is intended that the invention be construed as including all such modifications and alterations.

Having thus described the preferred embodiments, what is claimed is:

1. A quick connect/disconnect system for an arm of an excavator or other machine, said system comprising:

a boom comprising a distal end defining a first yoke structure comprising first and second yoke members, each of said yoke members comprising an open pin-receiving recess;

an arm including a distal end adapted for operative connection to an associated work implement, said arm comprising first and second pin-ends projecting outwardly from opposite lateral sides of the arm, said first pin-end seated in said pin-receiving recess of said first yoke member and said second pin-end seated in said pin-receiving recess of said second yoke member; and, first and second arm keepers located respectively adjacent said first and second pin-receiving recesses and selectively capturing said first and second pin-ends in said first and second recesses.

2. The quick connect/disconnect system as set forth in claim 1, further comprising:

a second yoke structure located on said arm and comprising first and second yoke members that respectively comprise first and second open pin-receiving recesses;

an arm cylinder operatively coupled between the boom and the arm and adapted for pivoting the arm relative to the boom, said arm cylinder comprising a distal end including first and second cylinder pin-ends projecting outwardly therefrom, said first cylinder pin-end seated in said first pin-receiving recess of said second yoke structure and said second cylinder pin-end seated in said second pin-receiving recess of said second yoke structure; and, first and second cylinder keepers located respectively adjacent said first and second pin-receiving recesses of said second yoke structure and selectively capturing said first and second cylinder pin-ends in said first and second recesses of said second yoke structure.

3. The quick connect/disconnect system as set forth in claim 2, further comprising a cylinder support assembly for temporarily supporting the arm cylinder, said cylinder support assembly selectively movable from a storage position to an extended operative position, said cylinder support assembly supporting said arm cylinder and maintaining said arm cylinder in a select position relative to said boom when in said extended operative position.

4. The quick connect/disconnect system as set forth in claim 3, wherein said cylinder support assembly comprises:

a support link pivotably connected to said boom and including at least one adjustment aperture defined therein;

a stop link pivotably connected to said boom and including at least one adjustment aperture defined therein;

a cylinder cradle connected to said support link and adapted for receiving and supporting said arm cylinder; and, a stop pin for insertion through said at least one adjustment aperture of said stop link and an aligned one of said at least one adjustment apertures of said support link to secure said support link said extended operative position.

5. The quick connect/disconnect system as set forth in claim 1, wherein said first pin-end is non-rotatably seated in said pin-receiving recess of said first yoke member and said second pin-end is non-rotatably seated in said pin-receiving recess of said second yoke member.

6. The quick connect/disconnect system as set forth in claim 2, wherein:

said first pin-end of said arm is non-rotatably seated in said pin-receiving recess of said first yoke member;

said second pin-end of said arm is non-rotatably seated in said pin-receiving recess of said second yoke member;

said first cylinder pin-end is non-rotatably seated in said first pin-receiving recess of said second yoke structure; and, said second cylinder pin-end is non-rotatably seated in said second pin-receiving recess of said second yoke structure.

7. The quick connect/disconnect system as set forth in claim 1, wherein said first and second arm keepers each comprises a cap that is selectively fixedly secured to said first yoke structure.

8. The quick connect/disconnect system as set forth in claim 2, wherein said first and second arm keepers each comprises a cap selectively fixedly secured to said first yoke structure, and wherein said first and second cylinder keepers each comprise a cap selectively fixedly secured to said second yoke structure.

9. The quick connect/disconnect system as set forth in claim 1, wherein said first and second arm keepers are releasably secured to said first yoke structure.

10. A quick connect/disconnect system for an arm of an excavator or other machine, said system comprising:

a boom comprising a distal end comprising first and second open pin-receiving recesses;

an arm comprising first and second pin-ends projecting outwardly from opposite lateral sides thereof, said first pin-end seated in said first pin-receiving recess and said second pin-end seated in said second pin-receiving recess; and, first and second arm-pin keepers located respectively adjacent said first and second pin-receiving recesses and selectively capturing said first and second pin-ends in said first and second recesses.

11. The quick connect/disconnect system as set forth in claim 10, wherein said arm comprises third and fourth open pin-receiving recesses and wherein said system further comprises:

an arm cylinder adapted for pivoting the arm relative to the boom, said arm cylinder comprising a distal end including first and second cylinder pin-ends projecting outwardly therefrom, said first cylinder pin-end seated in said third pin-receiving recess and said second cylinder pin-end seated in said fourth pin-receiving recess; and, first and second cylinder-pin keepers located respectively adjacent said third and fourth pin-receiving recesses and selectively capturing said first and second cylinder pin-ends in said third and fourth recesses.

12. A machine comprising:

a boom;

a fluid cylinder connected to the boom; and, a cylinder support assembly connected to said boom and adapted for temporarily supporting the fluid cylinder relative to the boom, said cylinder support assembly selectively movable from a storage position while connected to the boom to an extended operative position, said cylinder support assembly supporting said fluid cylinder and maintaining said fluid cylinder in a select position relative to said boom when in said extended operative position.

13. The machine as set forth in claim 12, wherein said cylinder support assembly comprises:

a support link pivotably connected to said boom and including at least one adjustment aperture defined therein;

a stop link pivotably connected to said boom and including at least one adjustment aperture defined therein;

a cylinder cradle connected to said support link and adapted for receiving and supporting said fluid cylinder; and, a stop pin for insertion through said at least one adjustment aperture of said stop link and an aligned one of said at least one adjustment apertures of said support link to secure said support link said extended operative position.

* * * * *